US010759549B2

(12) United States Patent
Commandeur

(10) Patent No.: US 10,759,549 B2
(45) Date of Patent: Sep. 1, 2020

(54) DEVICE AND METHOD FOR THE DRYING OF PACKAGING

(71) Applicant: SIG Technology AG, Neuhausen am Rheinfall (CH)

(72) Inventor: Markus Commandeur, Juchen (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 298 days.

(21) Appl. No.: 15/749,259

(22) PCT Filed: Jul. 26, 2016

(86) PCT No.: PCT/EP2016/067775
§ 371 (c)(1),
(2) Date: Jan. 31, 2018

(87) PCT Pub. No.: WO2017/036680
PCT Pub. Date: Mar. 9, 2017

(65) Prior Publication Data

US 2018/0222607 A1 Aug. 9, 2018

(30) Foreign Application Priority Data

Aug. 31, 2015 (DE) ..... 10 2015 114 457

(51) Int. Cl.

| | |
|---|---|
| ***F26B 5/14*** | (2006.01) |
| ***B65B 3/02*** | (2006.01) |
| ***B65B 51/32*** | (2006.01) |
| ***B65B 51/10*** | (2006.01) |
| ***B65B 55/10*** | (2006.01) |
| ***B65B 61/00*** | (2006.01) |

(52) U.S. Cl.
CPC ..... *B65B 3/027* (2013.01); *B65B 51/10* (2013.01); *B65B 51/32* (2013.01); *B65B 55/10* (2013.01); *B65B 61/002* (2013.01); *B65B 2051/105* (2013.01)

(58) Field of Classification Search
CPC ..... B65B 7/00; B65B 51/10; B65B 3/027; B65B 61/002; B65B 51/32; B65B 2051/105; F26B 13/26; F26B 13/28
USPC ..... 34/95.4, 95, 397, 14
See application file for complete search history.

(56) References Cited

U.S. PATENT DOCUMENTS

| | | | |
|---|---|---|---|
| 4,249,978 | A | 2/1981 | Baker |
| 4,636,186 | A | 1/1987 | Focke et al. |
| 5,053,196 | A | 10/1991 | Ide et al. |

(Continued)

FOREIGN PATENT DOCUMENTS

| | | | |
|---|---|---|---|
| CN | 202022325 | U | 11/2011 |
| CN | 102365206 | A | 2/2012 |

(Continued)

*Primary Examiner* — John P McCormack
(74) *Attorney, Agent, or Firm* — The Webb Law Firm

(57) ABSTRACT

Shown and described is a device for the drying of packaging, in particular composite packaging for foodstuffs, including: a conveyor belt with cells for receiving the packaging, and at least one drying facility for drying the packaging. In order to achieve particularly efficient drying of the packaging, it is envisaged that the drying facility has at least one contact element with at least one contact surface. Also shown and described are the use of such a device for the drying of packaging filled with foodstuffs, method for drying packaging, and a packaging for foodstuffs.

14 Claims, 12 Drawing Sheets

(56) References Cited

U.S. PATENT DOCUMENTS

| | | | | |
|---|---|---|---|---|
| 5,058,360 | A | 10/1991 | Yamazaki et al. | |
| 5,249,416 | A | 10/1993 | Adams et al. | |
| 5,467,579 | A | 11/1995 | Boriani et al. | |
| 5,755,080 | A | 5/1998 | Draghetti et al. | |
| 5,829,228 | A | 11/1998 | Mogard | |
| 6,129,099 | A * | 10/2000 | Foster | B08B 1/02 134/111 |
| 10,323,343 | B2 * | 6/2019 | Tsujimoto | D03D 47/32 |
| 2003/0044552 | A1 * | 3/2003 | Komada | B32B 27/08 428/35.7 |
| 2006/0066665 | A1 * | 3/2006 | Kachi | B41J 2/16538 347/33 |
| 2008/0289134 | A1 * | 11/2008 | Boussicot | B60S 1/386 15/250.32 |
| 2011/0314771 | A1 | 12/2011 | Dall'omo | |
| 2013/0305659 | A1 * | 11/2013 | Kenn | B65B 3/027 53/426 |

FOREIGN PATENT DOCUMENTS

| | | | |
|---|---|---|---|
| DE | 4220376 | A1 | 12/1992 |
| DE | 68911422 | T2 | 4/1994 |
| DE | 69217577 | T2 | 7/1997 |
| DE | 102010050502 | A1 | 5/2012 |
| DE | 102013015638 | A1 | 3/2015 |
| DE | 102013114642 | A1 | 6/2015 |
| EP | 0017678 | A1 | 10/1980 |
| EP | 0243757 | A2 | 11/1987 |
| EP | 0741081 | A2 | 11/1996 |
| EP | 2607248 | A1 | 6/2013 |

* cited by examiner

DEVICE AND METHOD FOR THE DRYING OF PACKAGING

CROSS-REFERENCE TO RELATED APPLICATIONS

This application is the United States national phase of International Application No. PCT/EP2016/067775 filed Jul. 26, 2016, and claims priority to German Patent Application No. 10 2015 114 457.3 filed Aug. 31, 2015, the disclosures of which are hereby incorporated in their entirety by reference.

BACKGROUND OF THE INVENTION

Field of the Invention

The invention relates to a device for the drying of packaging, in particular composite packaging for foodstuffs, comprising: a conveyor belt with cells for receiving the packaging, and at least one drying facility for the drying of the packaging.

The invention additionally relates to the use of such a device for the drying of packaging filled with foodstuffs, in particular for the drying of composite packaging filled with foodstuffs.

The invention also relates to a method for the drying of packaging, in particular composite packaging for foodstuffs, comprising the following steps: a) Provision of a device for the drying of packaging with a drying facility, b) Provision of packaging preferably formed from packaging sleeves, and c) Drying of the packaging.

Finally, the invention relates to packaging for foodstuffs, whereby the packaging is made from a multi-layer laminate.

DESCRIPTION OF RELATED ART

Packaging can be manufactured using different methods and from a wide variety of materials. A popular option for its manufacture consists of producing, from the packaging material, a cut length from which, by means of folding and further steps, initially a packaging sleeve and ultimately packaging is formed. This type of manufacture has, among other things, the advantage that the cut lengths are very flat and can therefore be stacked in a space-saving manner. By this means, the cut lengths or packaging sleeves can be manufactured at a different location from where the folding and filling of the packaging sleeve takes place. By way of materials, composites are frequently used, for example a composite of several thin layers of paper, cardboard, plastic or metal, particularly aluminium. Such packaging is particularly widespread in the food industry.

Packaging, in particular composite packaging, serves as transport packaging and/or protective packaging for foodstuffs, whereby the foodstuffs may have liquid or paste-like states. In addition, solid particles measuring several cubic millimetres in size may be mixed in with the foodstuffs. The foodstuffs may be for example drinks, soups, yoghurt, blancmange, sauces or similar.

Two different methods have established themselves for the manufacture of composite packaging:

In a first method, tubes are formed in an axial direction around a filling mandrel from sheet material pulled from a roll. The tubes are filled in continuous operation and sealed to form pillow-like containers. These pillow-like containers are then reshaped, in further steps, into compact structures, in particular into rectangular-shaped boxes. In this reshaping process, the protruding folds which are generated in the previous step and which the person skilled in the art frequently also terms "ears" are also attached to the outer side of the pack and connected to the latter, mostly heat-sealed or glued. This happens either in a continuous process, whereby the connecting takes place by means of a rolling process, or in a cyclical process, whereby the packaging to be reshaped is brought to a stop at one station and has pressure—which acts against the filled pack—applied to it by means of a pressing tool.

Here it is usual for the "ears" on what will later be the base of the packaging to be folded inwards, i.e. to form a part of the envisaged standing surface of the packaging, whilst the "ears" on the gable sides are attached to the vertical outer surfaces of the packaging. Because the packaging and its contents are only collectively sterilised in what is known as an autoclaving process following completion of manufacture, the folding or attachment and the subsequent fixing of the "ears" onto the packaging is fairly straightforward, since the surfaces to be connected are dry and clean. It is therefore completely sufficient to (start to) melt the external polymer layer of the laminate and to press on the "ears" to the areas of the resulting composite packaging intended for this purpose. The maximum temperature to be reached in the subsequent sterilisation process—i.e. in what is known as the autoclaving process—must then only remain below the melting point of the external polymer layer, already referred to, of the composite packaging, so that the glued-on ears do not become detached again.

It may however, for a variety of reasons, be desirable or necessary to sterilise the packaging and its contents separately from one another and to then carry out the filling process within a sterile zone, what is known as an aseptic zone. By this means, particularly valuable contents, for example, can be protected and preserved.

In the case of separate sterilisation of packaging and contents, a second filling procedure is frequently used, which is presented briefly below:

Firstly, likewise a laminate present as sheet material is reshaped in a process step upstream of the filling device into folding boxes, also called packaging sleeves. These folding boxes or packaging sleeves can then already be reshaped, in a filling device, into a relatively stable container that is only open in the direction of the filling nozzle which in this state is also called a "beaker" by the person skilled in the art. These "beakers" are then filled in a filling machine—which is mostly equipped with what is known as an aseptic zone—and directly after the filling process sealed by a device for the sealing of composite packaging filled with an incompressible fluid charge and formed from a folding box. The device forms a part of the filling machine and can be operated with it in continuous or cyclical operation.

Such a device comprises several successively arranged processing stations, along which a production path is formed. One of these processing stations usually has a drying facility with which at least a partial area of the surface of the composite packaging is dried. The production path of the drying facility is part of the production path of the filling machine.

With what are known as "multi-track filling machines", several production paths are formed parallel to each other. However, a production path, taken in isolation, always comprises a number of processing stations arranged in series and intermediate paths located between them. In general, the resulting composite packaging, or composite packaging to be processed, is led past the individual processing stations by means of a transport device, for example a rotating wheel, a conveyor belt or a transport chain. Devices which are to be operated in cyclical operation differ from devices which are to be operated in continuous operation in that the transport speed of the composite packaging becomes zero in defined cycles. This means that the packaging units then come to a stop within a particular processing station.

With this—second—manufacturing method, too, it is usual that the protruding "ears" on what will later be the base of the packaging are folded inwards, i.e. form a part of the envisaged standing surface of the packaging, whilst here, too, the gable-sided "ears" are attached to the vertical outer surfaces of the packaging. Here, the attachment of the gable-sided "ears" to the vertical or—with exotic forms of packaging—inclined outer surface of the packaging is justified not only by this being visually perceived as more pleasant. For process-related reasons, there may namely be an accumulation of condensation on the horizontal upper side of the packaging. The moisture can hinder or prevent the heat-sealing or gluing that takes place during attachment of the ears and is therefore undesirable.

It may, however, be desirable for aesthetic and/or functional reasons to produce packaging which in the upper region takes on such a shape that it becomes necessary to fill it via the side of the packaging which later forms the packaging base. In other words, the packaging must then be led "upside down" through the filling area. One example of composite packaging to be manufactured in this way is the applicant's "Combidome" packaging which thanks to its truncated-pyramid-shaped gable area not only has an attractive exterior but also excellent pouring behaviour.

As already described, however, this entails the problem that the "ears" are attached to the packaging, and must be fastened, on a horizontal surface on which for process-related reasons condensation may be formed. This is additionally hindered by the fact that the previously shifted base seal seam ("fin seal") creates a bulge in whose vicinity a recess may also arise. Finally, the fixing of the "ears" in the base area must also have a particularly stable design since the base on the one hand is exposed to particularly high stress during the course of a usual composite packaging lifetime. In addition, in the area of connection between the base-sleeve surface and the "ears", shear stresses unfavourable to a glued or heat-sealed connection arise as a result of the sinking—due to gravity—of the charge.

For the drying of packaging, drying facilities are known which dry the packaging, that is already filled and sealed, using hot air. However, this method has several disadvantages. Because generating hot air is energy-intensive and therefore expensive. In addition, the packaging—and its decoration—can be damaged through too great an exposure to heat.

Against this backdrop, an object underlying the invention is to design and further develop a device, described at the beginning and outlined in more detail above, in such a way that damage-free and energy-saving drying of packaging that is already filled and sealed becomes possible. This drying should, in particular, take place in the area of the ears of the packaging that are to be attached.

SUMMARY OF THE INVENTION

In one device this object is achieved by the drying facility having at least one contact element with a contact surface.

A device according to the invention for the drying of packaging features firstly a conveyor belt with cells for receiving the packaging. A conveyor belt is understood to mean any suitable means of transport, for example a transport chain or a transport belt. Preferably, the conveyor belt is designed so as to move in a full loop—i.e. "endless". Cells are understood to mean any elements which are suitable for carrying packaging, for example clamping elements, frames, containers or such like. Preferably, the cells are connected firmly or detachably to the conveyor belt. In addition, the device features at least one drying facility for the drying of the packaging. The purpose of the drying facility is to reduce the moisture on the surface of the packaging or remove it from the packaging surface.

According to the invention, it is proposed that the drying facility has at least one contact element with at least one contact surface. The contact element and its contact surface are arranged and designed in such a way that the packaging transported by the conveyor belt touches the contact surface of the contact element, whereby the contact surface wipes off or strips moisture from the packaging. The invention is therefore based on the idea of providing, instead of contact-free drying (e.g. by means of hot air), drying involving contact. This has the major advantage that drying can also be carried out safely immediately adjacent to sensitive areas, for example the aseptic zone of a filling device. If several contact surfaces are provided, it is preferred that the contact surfaces are arranged at an angle to one another (for example approximately 90°). In this way surfaces of the packaging that are at angles to one another can also be simultaneously dried.

Preferably the contact element is mounted so as to be moveable. The mounting may for example permit movement with one, two or three degrees of freedom. Here a degree of freedom is understood to mean freedom of movement in a translational or rotatory direction around a particular spatial axis. Initially the movability with a degree of freedom has the advantage that the contact element can act mechanically on a surface of packaging to be dried even if the latter is standing still. Even if the packaging moves past the contact element along its transport route, it can be a great advantage if the contact element is mounted so as to be moveable. By this means it can be possible, for example, for the contact element, in a resting position, to protrude into the movement space of the packaging provided and to be driven out of this space by the packaging. For this to occur it is sufficient, for example, for the contact element to be swivel-mounted around an axis which is aligned vertically in relation to the direction of transportation/the production path of the packaging. The contact element is then pressed with its own weight against the surface of the packaging that is to be cleaned and/or dried. The effective weight force may optionally be supported through the provision of a spring force. In other cases it may be desirable for the contact element to be mounted so as to be rotatable and preferably capable of moving all the way round. The resulting relative speeds between the contact surface and the surface of the packaging to be dried can significantly support the drying process. Here the pressing forces can be kept very low, as a result of which the decoration on the surface to be dried is protected.

Preferably the contact element is designed to be temperature-controllable, i.e. heatable and/or coolable, as a result of which, for example, a condensation effect can be effectively promoted or prevented on the contact element, preferably in individual areas of the contact element.

The device can, in a further embodiment, be supplemented by a facility for the attachment of protruding ears to the packaging. Such a facility can perform not only the attachment of the ears but also the fixing of the ears to the packaging. The fixing of the ears to the packaging mostly takes place by means of gluing or heat-sealing and therefore requires dry and clean surfaces. Consequently, the combination of a drying facility and a facility for the attachment of ears offers particular advantages. Preferably, the facility for the attachment of the protruding ears is, viewed from direction of transport of the packaging, arranged behind the drying facility.

According to one embodiment of the device, it is provided that the drying facility has at least two contact elements. Preferably, each of these contact elements has at least one contact surface. Through the provision of several contact elements, several packaging units can be dried simultaneously. This can for example be achieved by the packaging units being transported in several rows, preferably in parallel to each other, through the drying facility. Alternatively, or in addition to this, it can also be provided that several contact elements are allocated to the same row of packaging units and are—viewed in the direction of transport—arranged behind one another. By this means, every packaging unit is dried successively by several contact elements.

In a further embodiment of the device it is provided that the contact surface of the contact element is made from plastic, in particular from an elastomer or a thermoplastic. Many plastics feature high elasticity; contact surfaces made from plastic can therefore adapt particularly well to the shape of the surfaces of the packaging to be dried. This permits particularly thorough drying of the packaging. A further advantage of the elasticity or flexibility of many plastics lies in the fact that the packaging is not damaged in spite of the contact. In addition, plastics can be very variably shaped, so that contact surfaces with complex geometries are also possible. Plastics belonging both to the group consisting of elastomers and the group consisting of thermoplastics have proved to be a particularly suitable material. From the group consisting of elastomers, in particular rubbery elastomers are a possibility, whilst from the group consisting of thermoplastics, PEEK (polyether ether ketone) has turned out in trials to be a particularly suitable material. Materials with related properties are also an option. Here it is important, among other things, that the materials are resistant to the cleaning and/or disinfectant agents used. In the preferred area of application of the device, i.e. within a filling device, which preferably serves the aseptic filling of foodstuffs, $H_2O_2$ is a customary disinfectant. Preferably the contact surface is designed to be replaceable, so that in the event of wear and tear the entire contact element does not need to be replaced.

It is a major advantage if the contact surface of the contact element is formed from a material on whose surface water forms a contact angle of less than 60°, preferably less than 45°, very preferably less than 29°. Here the contact angle must be determined according to the specifications of DIN 55660-2 and in particular according to the static methods described therein and in compliance with the recommendations given therein (DIN 55660-2: "Coating materials—Wettability—Part 2: Determination of the free surface energy of solid surfaces through measurement of the contact angle", Dec. 2011, in particular Item 5.2.2: Static Method).

Advantageously, the contact surface of the contact element can be constructed using an open-pored material. Then the effect of capillary permeation can be used, as a result of which the desired drying and/or cleaning process is particularly well supported. Capillary permeation or wetting is the movement of a fluid on a solid substrate which is driven forward by the interfacial energy. The capillary permeation is quantified by the contact angle, which is determined according to the specifications of DIN 55660-2 and in particular according to the static methods described therein and in compliance with the recommendations given therein. A low contact angle means stronger wetting by a given liquid. A suitable high capillary permeation corresponds to a contact angle of less than approximately 90°.

By way of an alternative to this, the contact surface of the contact element can, advantageously, be constructed using a close-pored material. By this means the contact element can meet hygienic requirements particularly well. In addition, it is simple to clean.

By way of an alternative to this, the material forming the contact surface may also be a coating material. By this means, the manufacture of the contact element can be designed to be less complicated and more cost-effectively. In addition, materials can be selected which meet the differing requirements of contact element and contact surface.

It may be advantageous here if the contact element also has at least one function surface whose surface, with water, has a contact angle of more than 100°, preferably more than 120°, i.e. is designed to be hydrophobic. A function surface is understood, in this immediate context, to mean a surface which comes into contact with the water that has to be removed from the surface of the packaging to be manufactured. A function surface so designed could then be used for example to eliminate the water that has been removed from contact element and occasionally temporarily stored.

It is also advantageous if the surface tension of the material forming the contact surface of the one contact element, of which there is at least one, measured according to WU is at least 32 mN/m, preferably at least 35 mN/m and very preferably at least 40.5 mN/m (equation proposed by G. X. Wu in 1982 for calculation of the surface tension).

It can be provided that the contact surface of the contact element is designed to be elastically deformable. An elastically deformable design is understood here to mean a material which, with an energy acting at an angle of between 90° and 60° of at least 0.125 joules, deforms by at least 5° from its original shape, and upon rebound reforms itself into its original state. A work energy of approximately 0.125 joules occurs for example when a packaging unit weighing approximately 250 grams comes into contact with the contact element at a speed of approximately 1 m/s. An elastically deformable contact surface has the advantage that it automatically adapts to the features of the surface to be dried and can—at least largely—follow it. As a result it is ensured that quantities of liquids that have accumulated in recesses can also be effectively collected and removed.

It can also be provided that the contact surface of the contact element is given a rigid design. A rigid design is understood to mean a material which, with a work energy of 0.5 joules acting at an angle of between 90° and 60°, does not visibly deform i.e. at least below 2°. A contact surface with a rigid design has the advantage that it is particularly low-maintenance and can deliver constant output over a virtually unlimited time period. This results in high process safety and saves costs.

According to a further embodiment of the device, it is envisaged that the contact surface of the contact element has a profile with at least one recess. The recesses may for example have a depth in the range between 1 mm and 5 mm, in particular between 2 mm and 4 mm. From the recesses, moisture can be taken up and be drained away—for example to the outside. In addition, the recesses are surrounded and limited by edges; these act as "sealing lips" and thereby ensure improved drying performance.

Through a profile, liquid to be removed from the surface of the packaging is given a means of escape. In particular, a profile helps prevent the occurrence of what is known as an aquaplaning effect in the case of a relatively large quantity of liquid to be removed. If such an effect occurred this would have the consequence of the contact element lifting off slightly from the surface to be treated and would "slip" on a film of liquid that formed. This would then result in an even distribution of the existing quantity of liquid—which is to be removed—on the given surface, so that more no space remained on the surfaces to be treated on which effective material bonding bridges could be created by means of a gluing or heat-sealing process. The occurrence of an aquaplaning effect must therefore be carefully prevented in every case.

In addition, the effectiveness of a drying and/or cleaning process increases considerably if the contact surface of the contact element has a profile, because several edges are formed thereby which act particularly effectively when it comes to removing accumulations of liquid on a surface.

Here, by means of different shapes and arrangements and specifications of profiles—i.e. through the provision of suitable profile patterns and profile heights—a variety of additional advantages can be achieved.

If the profile has profile lines running diagonal to the direction of the transport route, this firstly offers the advantage that the surface to be treated of a packaging (unit) that is led along the production path is not suddenly exposed to a load across its entire width through the contact with a profile edge, something which could damage the decoration. If recesses, limited by individual profile lines, are provided in the contact element, it is also advantageous if channels or grooves running in the direction of the outer side edge of the contact element have an open design. This means that the recesses are not closed by means of a wall on the side that limits the width of the contact element. Hence the liquid temporarily received therein, in particular condensed water vapour, can be displaced to the side.

For this purpose it is advantageous if the recesses thus formed extend in a kind of herringbone pattern across at least part of the contact surface of the contact element. Such a design is particularly protective and effective.

It is also advantageous if the cross-sectional shape of the recesses is rectangular or a partial circle. Such shapes are inexpensive to manufacture and can also be suitable for receiving an appropriate quantity of liquid. In the event of a rectangular design of the recess, it is particularly preferred that the width of the recess is between 5 mm and 20 mm and in particular between 8 mm and 13 mm, whilst the depth should be in the range 1.5 mm to 6 mm and in particular between 2 mm and 3.5 mm. In the event of a partial circle shape, radii up to approximately 15 mm can be particularly preferred.

It can also be advantageous if the recesses formed generate a kind of scale-like or rhombic pattern on the contact surface of the contact element. By this means, a particularly large number of edges, that become active on the surface of the packaging, can be generated on the contact surface of the contact element.

In addition, in this way the stresses associated with the mechanical removal of the liquid to be removed are particularly well distributed on the entire partial surface to be cleaned, so that the individual edges can also be given a sharper design, which significantly increases the effectiveness. In particular, it is possible here to achieve edge radii or edge chamfers of less than R=1.0 mm or 0.5 mm×45° and even less than R=0.6 mm or 0.3×45°. If the scale-like or rhombic pattern in operation is designed diagonal to the direction of the production path, then here too, the effect of lateral displacement of the liquid to be removed can again be used.

In a further embodiment of the device, it is provided that the contact element has at least one channel for carrying a gaseous or liquid medium. Either moisture can be drained off from the packaging through the channel, or a drying medium (e.g. air) can flow to the packaging. It can be provided that the channel has one or more branches.

A further advantage of a channel lies in the fact that it can be used as a "pressure chamber", whereby the shape of the contact surface deforms as a function of the pressure in the chamber. By this means, the contact surface of the contact element can adapt particularly well to the surface structure of the surface to be cleaned. Owing to the pressure prevailing in the chamber, it is also achieved that the contact surface is, even in the case of deformations, constantly pressed against the surface that is in contact with it—i.e. with the surface to be cleaned. As a result of this, excellent preconditions are achieved for effective cleaning and/or drying. Through the pressure that can be set in the chamber, the deformation pressure and the contact pressure are additionally easily adjustable. For this purpose the contact element is preferably designed like a part of a tyre pulled in one plane.

Furthermore it is proposed that at least one outlet of the channel is arranged on the lateral contact surface and/or on the lower contact surface of the contact element. As a result of this arrangement of the outlets, the surfaces of the packaging to be dried can be reached particularly easily. In particular, the base surfaces (or gable surfaces) of the packaging and the inner sides of the ears can be reached simultaneously.

A further embodiment of the device finally provides that the contact element has a curved inlet area or an inlet area inclined relative to the contact surface. Through a curved or inclined shape, a gentle increase in the contact forces between the packaging units and the contact element is achieved. A further effect lies in the fact that the fin seal present on the upper and lower sides of the packaging is gently bent downwards. In this way the risk of the packaging units becoming 'stuck' on the contact element or being damaged by the contact element is reduced.

The previously described device is suitable, in all embodiments presented, in a particular way for a use for the drying of packaging filled with foodstuffs, in particular for the drying of composite packaging filled with foodstuffs. The good suitability results for example from the fact that the drying process permitted by the device is particularly gentle and the sensitive foods are barely exposed to stress. In particular, exposure of the packaging content to thermal stress is avoided, as occurs for example with drying by means of hot air. The foodstuffs may for example be aseptically filled foodstuffs.

The object described at the beginning is also achieved by means of a method for drying packaging, in particular composite packaging for foodstuffs, comprising the following steps: a) Provision of a device for the drying of packaging with a drying facility, b) Provision of packaging preferably formed from packaging sleeves and c) Drying of the packaging. The packaging provided is preferably composite packaging which is manufactured from a laminate, whereby the laminate is preferably shaped in an intermediate step into a packaging sleeve. The making available of such a packaging sleeve already described in more detail at the beginning is, in the event of provision of packaging formed from a packaging sleeve, therefore likewise already a key precondition for implementation of the method according to the invention.

According to the invention, the packaging is, in Step c), dried by means of a contact between the packaging and the drying facility. As has already been previously described in connection with the device, the method is also based on the idea of, instead of providing contact-free drying by means of hot air, providing drying of the packaging involving contact and wiping the moisture from the surface of the packaging. This has the advantage for example of a lower energy requirement and also protects the contents of the packaging from thermal stresses. Preferably, in Step c) the packaging is moved—either continuously or in cycles—whilst the drying facility stays still.

One embodiment of the method provides that in Step a) a device provided. The previously described device is suitable in a particular way for carrying out the method since the contact element can, both as regards its shape and as regards its material, can be tailored to a drying of packaging that involves contact.

In a further embodiment of the method it is proposed that the packaging units are, in Step c), dried by means of a contact between the packaging units and the contact element of the drying facility. This also has the advantage that the contact element can, both as regards its shape and as regards its material, can be tailored to a drying of packaging that involves contact.

According to a further embodiment of the method, it is provided that the packaging units are, in Step c), dried by means of a contact between the packaging units and the lower contact surface and/or the lateral contact surfaces of the contact element of the drying facility. The packaging units usually have several surfaces to be dried that are mostly not in one plane, for example the base (or gable surface) and the inner sides of the protruding ears. It is therefore advantageous to dry the different surfaces to be dried by means of different contact surfaces. One advantage lies in the fact that the contact surfaces can be optimally adapted to the surfaces to be dried by them in respect of their shape and position. In addition, several contact surfaces permit the simultaneous drying of several surfaces of the packaging.

The method can finally be supplemented by the following step: d) Attachment of the protruding ears to the packaging. As already previously described in connection with the device, drying helps, in particular, the subsequent gluing or heat-sealing of the ears to the packaging. Consequently a combination of the steps of drying and attachment/fixing of the ears is particularly advantageous. Accordingly, Step d) is preferably carried out after Step c).

Finally, what is being described herein is a packaging for foodstuffs whereby the packaging is manufactured from a multi-layer laminate. The packaging is characterised by the fact that the outermost layer of the laminate forms, with water, a contact angle of at least 60°, preferably at least 75°, in particular of at least 90°. Here the contact angle must be determined according to the specifications of DIN 55660-2 and in particular according to the static methods described therein and in compliance with the recommendations given therein. Packaging with a contact angle in the cited range is particular suitable for drying involving contact, since water droplets with such contact angles can be wiped from the surface of the packaging particularly easily.

By further increasing the contact angle, which is also called the edge or wetting angle, this effect can of course be further increased. Consequently it may be particularly preferred that the outermost layer of the laminate forms, with water, a contact angle of at least 110°, preferably of at least 135°, in particular of at least 150°. The surface of the packaging sleeve or of the packaging is then designed in a superhydrophobic range, or even exhibits what is known as a lotus effect. This has the advantage, for example, that the packaging, also during later use, has higher protection for the food contained within it, since microbes which come into contact with the packaging barely have the chance even of becoming established in the outer area of the packaging, but rather, e.g. with the resulting moisture (for example in the case of temperature fluctuations), simply run off. In relation to the drying facility, the contact element may, owing to what then are only minimal wiping forces required, be designed so simply that it can be replaced regularly and for example in the case of use of the device for the drying of packaging within a filling device, be simply replaced when it is cleaned.

Contact angles in the cited range can for example be achieved through a suitable choice of the outermost layer of the laminate forming the packaging.

BRIEF DESCRIPTION OF THE DRAWINGS

Below, the invention is explained in more detail with the aid of a drawing that shows one preferred embodiment. The following are shown in the drawing.

DESCRIPTION OF THE INVENTION

Figure 1A:
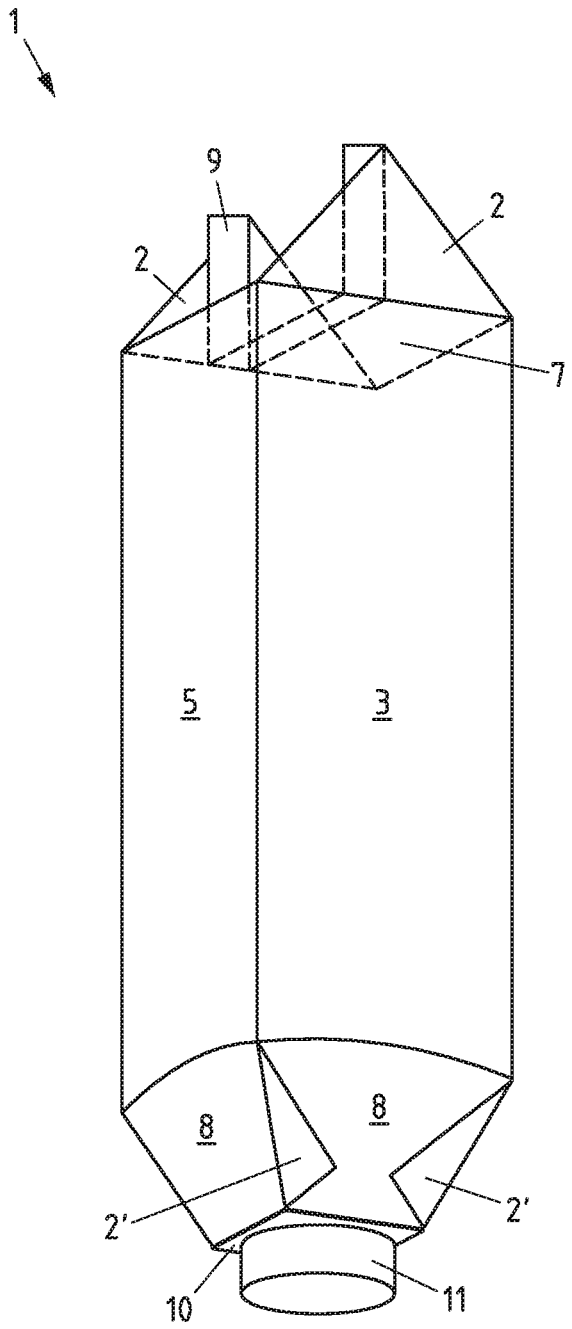
Fig.1A Prior Art
FIG. 1A: a first embodiment of a packaging with protruding ears known from the prior art.

FIG. 1A shows a first embodiment of a packaging 1 known from the prior art with protruding ears 2. The packaging 1 is manufactured from a multi-layer composite material which comprises layers of different material for example paper, cardboard, plastic or metal, in particular aluminium. The packaging 1 has a first lateral surface 3, a second lateral surface 4 (hidden), a front surface 5 and a rear surface 6 (hidden). In addition, the packaging 1 has base surfaces 7 and gable surfaces 8. The lateral surfaces 3, 4, the front surface 5 and the rear surface 6 are equally large, so that the packaging 1 has a square cross sectional area. The base surfaces 7 are folded and sealed (e.g. heat-sealed), in such a way that a fin seal 9 is formed. When the base surfaces 7 are folded, protruding areas of excess material are formed which form the ears 2 and in a subsequent manufacturing step—for example by means of a heat-sealing process—are to be attached to the packaging 1. The ears 2 approximately protrude from the packaging 1 in such a way that they run approximately parallel to the lateral surfaces 3, 4 of the packaging 1.

In the area of the gable surfaces 8, the packaging 1 shown in FIG. 1 is sealed by the gable surfaces 8 being folded slightly inwards and being connected to a pouring element 10 made from plastic. The pouring element 10 has a screw cap 11 which is likewise manufactured from plastic. When the gable surfaces 8 are folded, four ears 2' which protrude from the gable area of the packaging 1 are formed, which in the packaging 1 shown in FIG. 1 have already been attached to the gable surfaces 8. The manufacture of a packaging 1 shown in FIG. 1 is described for example in DE 10 2010 050 502 A1, to which reference is being made in this respect.

Figure 1B:
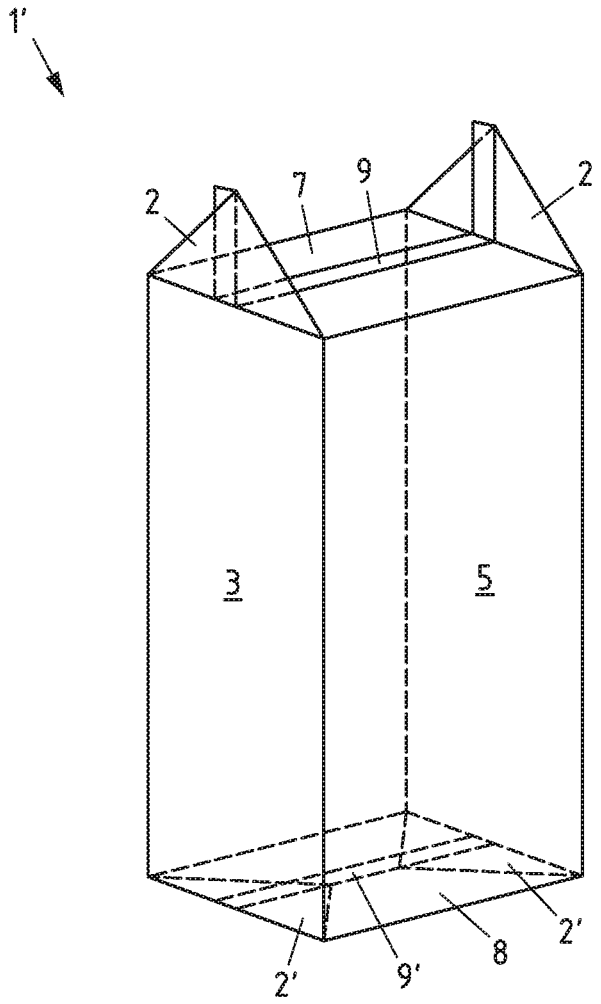
Fig.1B Prior Art
FIG. 1B: a second embodiment of a packaging with protruding ears known from the prior art.

FIG. 1B shows a second embodiment of a packaging 1' with protruding ears 2 known from the prior art. The areas of the packaging 1 already described in connection with FIG. 1A are given corresponding reference symbols in FIG. 1B. The packaging 1' shown in FIG. 1B differs from the packaging 1 shown in FIG. 1A by having a different cross sectional area and a different shape to the gable area. The lateral surfaces 3 and the lateral surface 4 (hidden) are narrower than the front surface 5 and the (hidden) rear surface 6, so that the packaging 1' has a rectangular cross sectional area. In addition, the base area (i.e. the area of the base surfaces 7) and the gable area (i.e. the area of the gable surfaces 8) of the packaging 1' are sealed by identical means, namely without the use a pouring element 10 through direct connection of the base surfaces 7 or the gable surfaces 8. When the base surfaces 7 and the gable surfaces 8 are connected, fin seals 9, 9' are formed. The only difference between the base area and the gable area of the packaging 1' lies in the fact that the ears 2' in the gable area have already been attached to the gable surfaces 8, whilst the ears 2 in the base area have not yet been attached to the base surfaces 7 and therefore still protrude from the packaging 1'. The ears 2 approximately protrude from the packaging 1' in such a way that they run approximately parallel to the lateral surfaces 3, 4 of the packaging 1'.

Figure 1C:
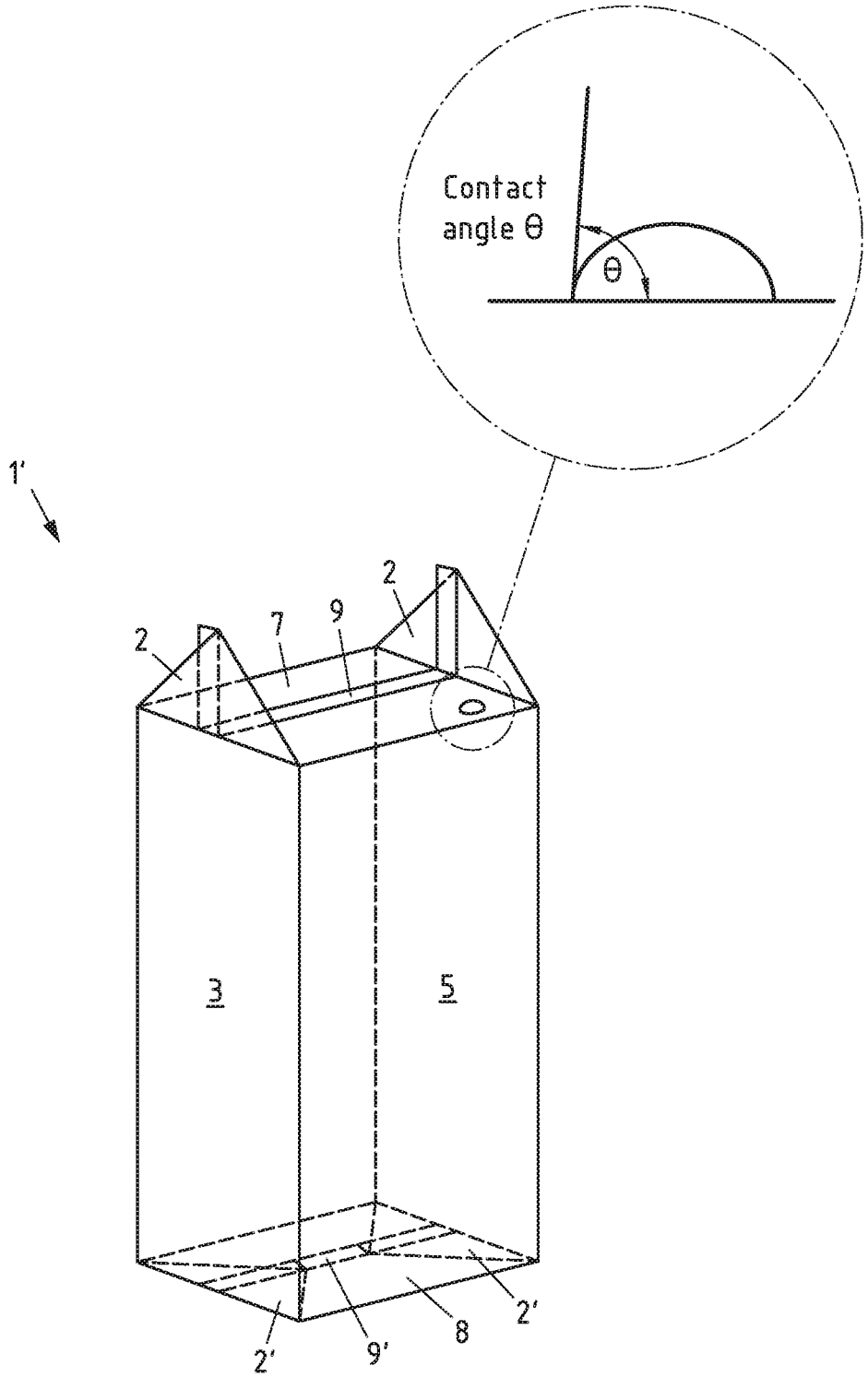
FIG. 1C: a packaging with protruding ears according to the invention.

FIG. 1C shows a packaging 1' according to the invention with protruding ears 2. The areas of the packaging 1, 1' already described in connection with FIG. 1A and FIG. 1B are given corresponding reference symbols in FIG. 1C. The packaging 1' shown in FIG. 1C differs from the packaging 1' shown in FIG. 1B by having a different outer layer. The changed outer layer results in a particularly favourable contact angle Θ. The contact angle Θ refers to that angle which the outermost layer of the laminate of the packaging 1' forms with a water droplet. The contact angle Θ in turn is to be determined according to the specifications of DIN 55660-2 and in particular according to the static methods described therein and in compliance with the recommendations given therein.

Figure 1D:
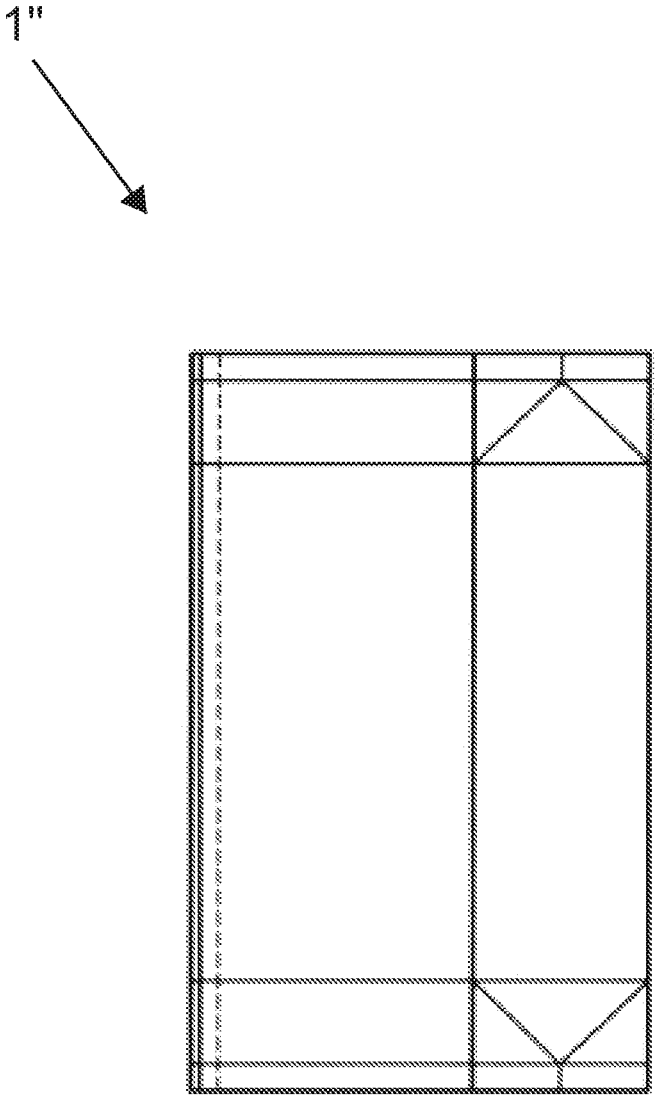
FIG. 1D: an embodiment of a packaging sleeve.

FIG. 1D shows an embodiment of a packaging sleeve 1". Packaging can be manufactured using different methods and from a wide variety of materials. A popular option for its manufacture consists of producing, from the packaging material, a cut length from which, by means of folding and further steps, initially a packaging sleeve 1" and ultimately packaging is formed. This type of manufacture has, among other things, the advantage that the cut lengths are very flat and can therefore be stacked in a space-saving manner. By this means, the cut lengths or packaging sleeves 1" can be manufactured at a different location from where the folding and filling of the packaging sleeve 1" takes place. By way of materials, composites are frequently used, for example a composite of several thin layers of paper, cardboard, plastic or metal, particularly aluminum. Such packaging is particularly widespread in the food industry.

Figure 2A:
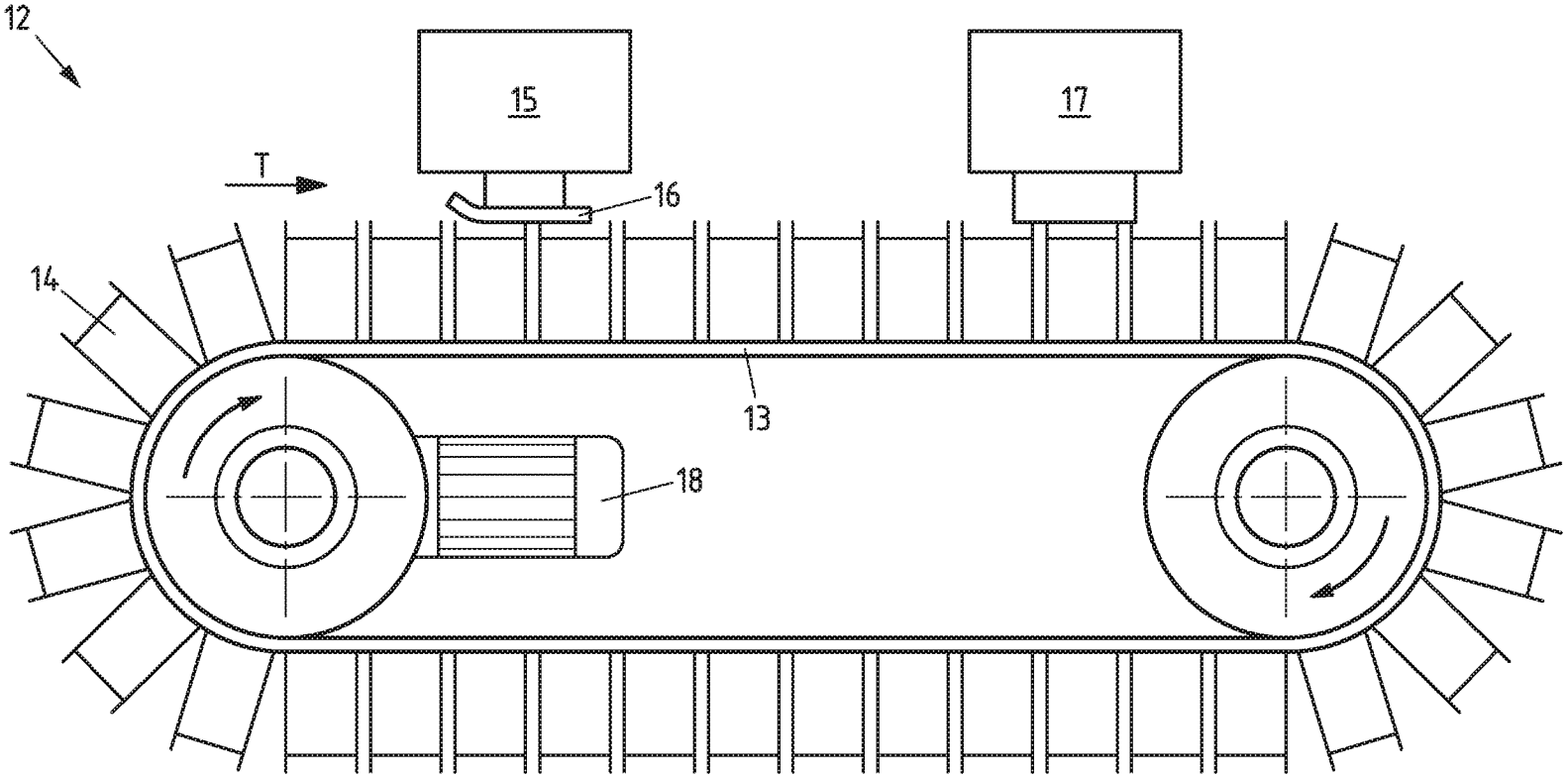
FIG. 2A: a first embodiment of a device according to the invention, front view.

FIG. 2A shows a first embodiment of a device 12 according to the invention for the drying of composite packaging for foodstuffs in a front view. The device 12 comprises firstly a conveyor belt 13 with cells 14 for receiving the packaging 1. In place of a conveyor belt 13 a transport chain, transport belt or other suitable means of transport may be provided. In addition, the device 12 comprises a drying facility 15 for drying the packaging 1. The drying facility 15 has a contact element 16 which shall be addressed in more detail below. The packaging units 1 that are already filled and sealed are located in the cells 14 and are led from the conveyor belt 13 in a transport direction T past the stationary contact element 16 in such a way that a partial area of the packaging 1—in particular the fin seal 9—touches the contact element 16, whereby the contact element 16 strips moisture from the packaging 1. This principle is comparable with a windscreen wiper on vehicles. FIG. 2A also shows a facility 17 for attaching protruding ears 2 to the packaging 1. Although the facility 17 is not a component of the device 12, it assists with the explanation of its operation. This is because the drying of the packaging 1 in particular serves the purpose of being able to reliably attach the ears 2 to the packaging 1. This mostly takes place by means of heat-sealing processes, which is why dry surfaces are required for a reliable connection. The conveyor belt 13 can for example be driven by an electric drive 18.

Figure 2B:
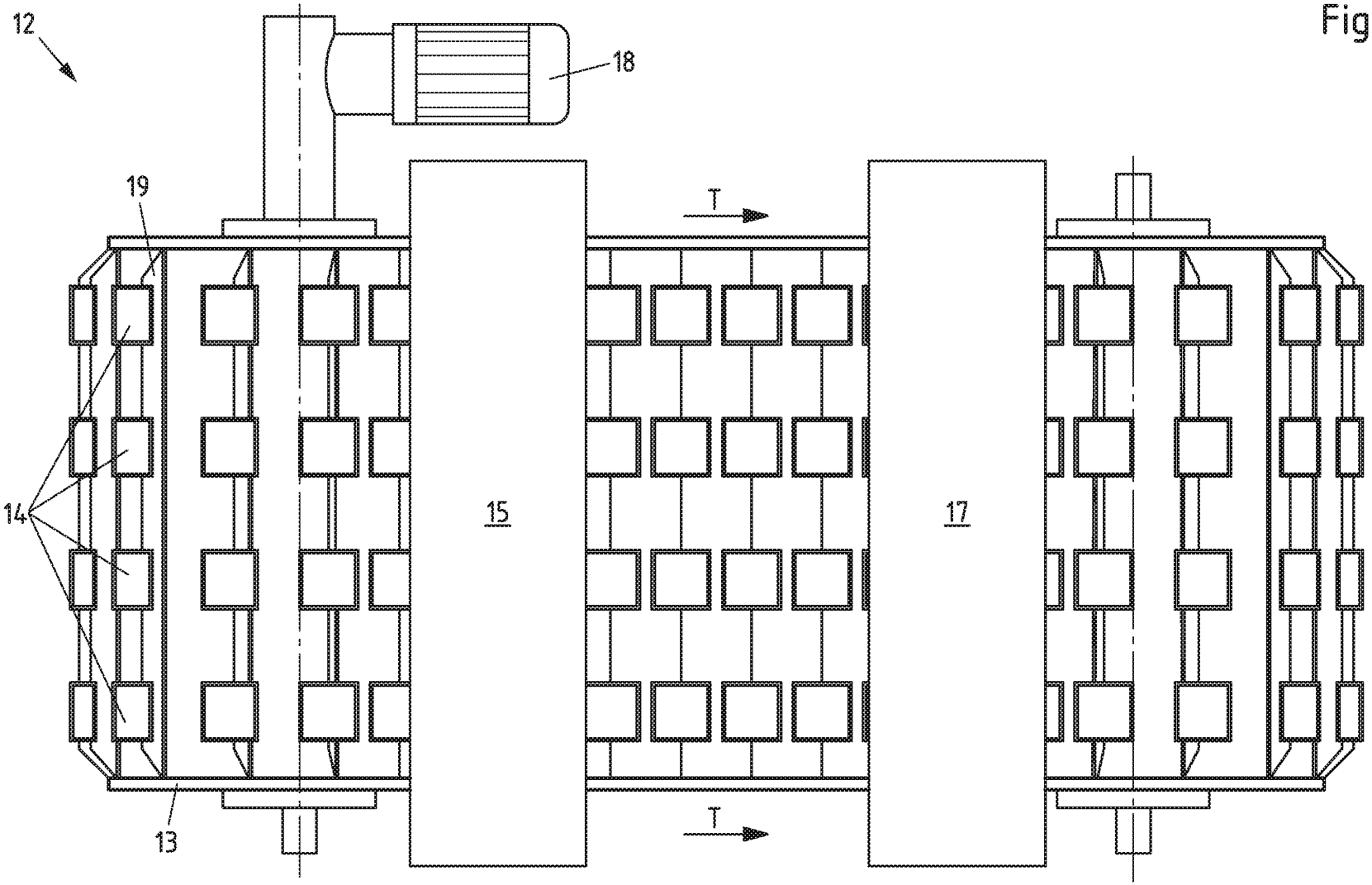
FIG. 2B: the device from FIG. 2A, plan view.

FIG. 2B shows the device 12 from FIG. 2A in plan view. The areas of the device 12 already described in connection with FIG. 2A are given corresponding reference symbols in FIG. 2B. In the plan view it can be clearly recognised that the conveyor belt 13 has four rows of cells 14. In order to enable the simultaneous processing of four packaging units 1 in the drying facility 15 and/or in the facility 17 for attachment of the protruding ears 2, both facilities 15, 17 extend across the entire width of the conveyor belt 13. In addition, both facilities have an appropriate number of tools; the drying facility 15 shown in FIG. 2B therefore has four contact elements 16. The configuration shown in FIG. 2B is only to be understood as an example; in particular, the number of rows of cells 14 can be varied. For example, only a single row of cells 14 may be provided. In this case, the cells 14 can be directly connected to the conveyor belt 13. Alternatively, two or more rows of cells 14 may be provided. In this case, the cells 14 may for example be connected via a collective cross member 19 to the conveyor belt 13.

Figure 2C:
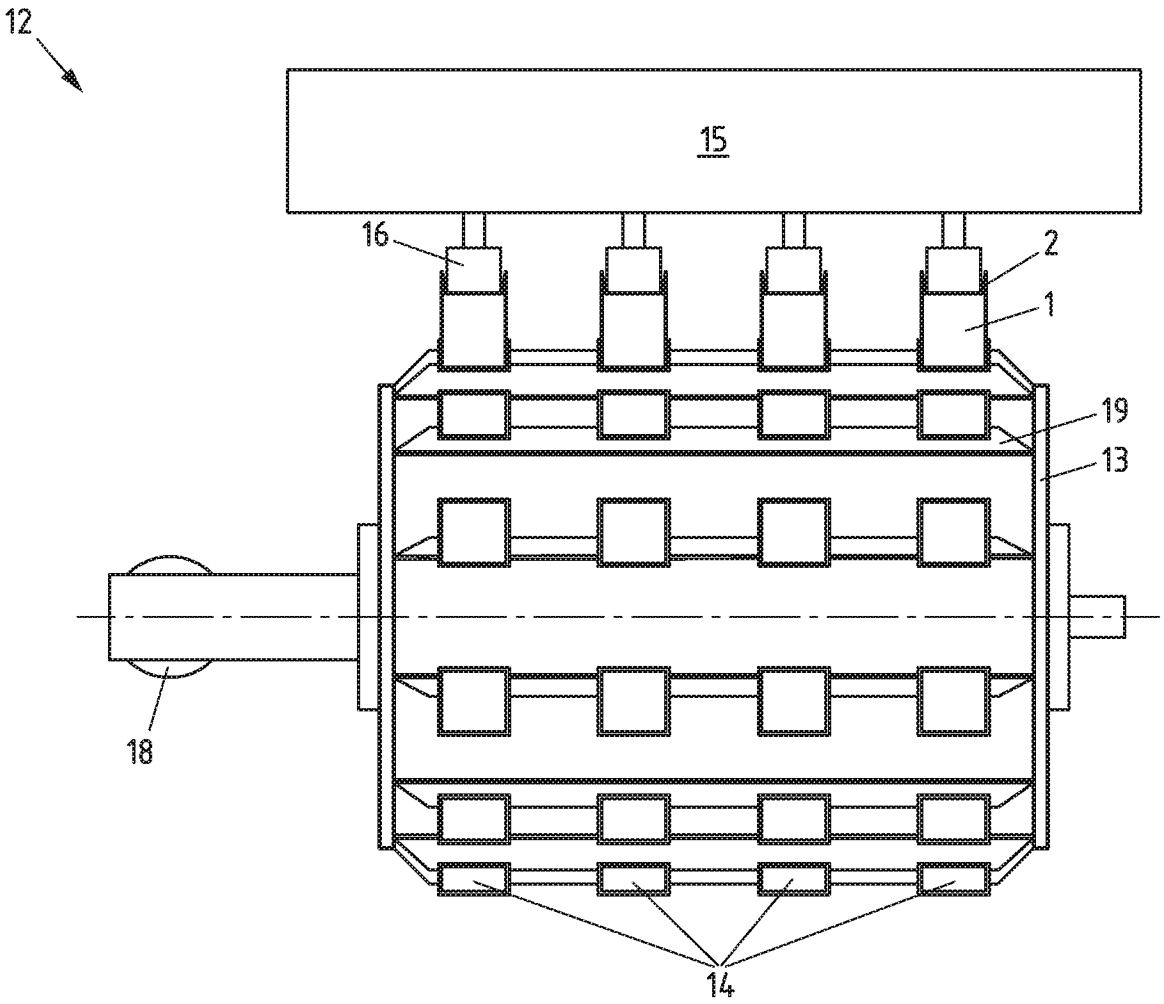
FIG. 2C: the device from FIG. 2A, side view.

FIG. 2C shows the device 12 from FIG. 2A in a side view. The areas of the device 12 already described in connection with FIG. 2A and FIG. 2B are given corresponding reference symbols in FIG. 2C. In the side view it is clearly discernible that four packaging units 1 with protruding ears 2 are simultaneously processed by the four contact elements 16 of the drying facility 16. The contact elements 16 come into contact with the packaging units 1 both in the area of their base surfaces 7 (and the fin seals 9 that run there) and also on the inner sides of the protruding ears 2 (and the fin seals 9 that likewise run there). In this way, drying of the base surfaces 7 as well as of the inner sides of the ears 2 and of the fin seals 9 is achieved. This has the advantage that all the surfaces affected by the attachment of the ears 2 to the packaging 1 are dried. The packaging units 1 shown in FIG. 2A to FIG. 2C may for example be the packaging 1 described in connection with FIG. 1A.

Figure 3A:
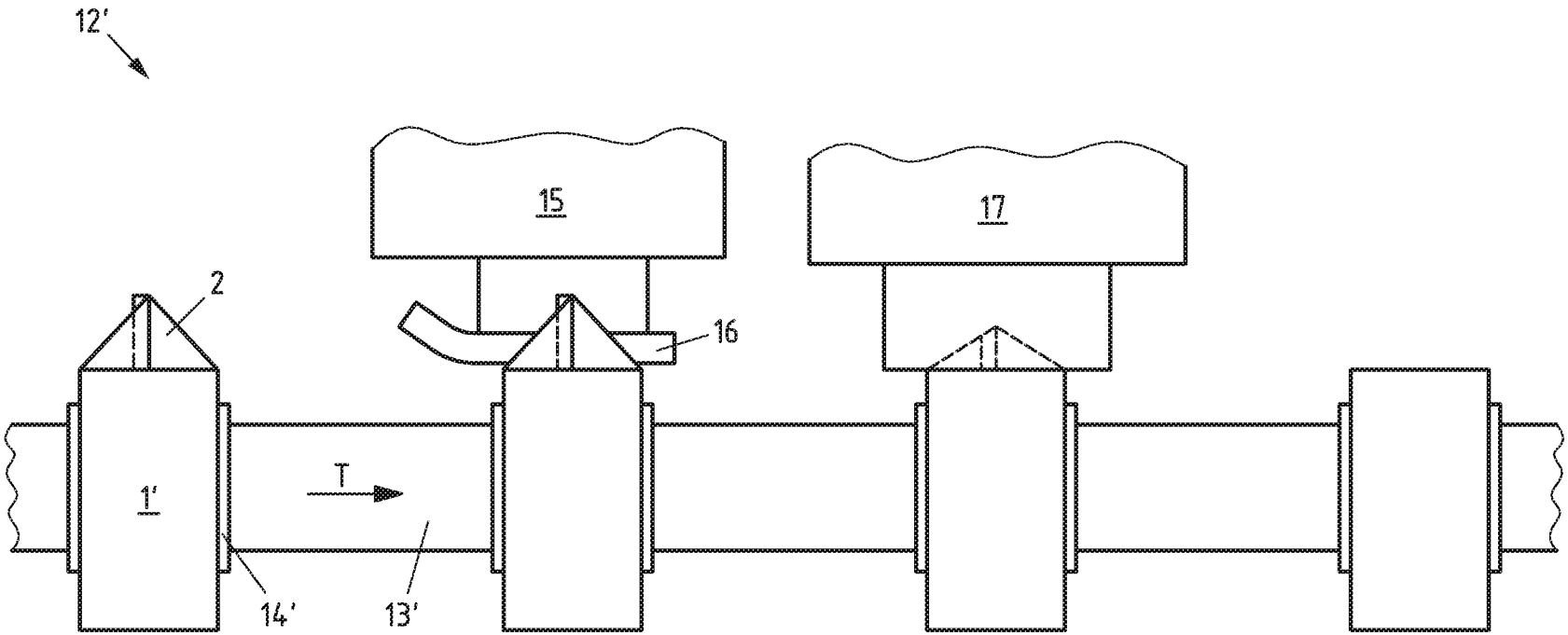
FIG. 3A: a second embodiment of a device according to the invention, front view.

FIG. 3A shows a second embodiment of a device 12' according to the invention for the drying of composite packaging for foodstuffs in a front view. The areas of the device 12' already described in connection with FIG. 2A to FIG. 2C are given corresponding reference symbols in FIG. 3A. A key difference between the second embodiment of the device 12' and the previously described first embodiment of the device 12 (FIG. 2A to FIG. 2C) lies in the fact that the conveyor belt 13' in the second embodiment of the device 12' runs not beneath but behind or next to the packaging units 1'. A further difference lies in the fact that the packaging units 1' are, in the second embodiment of the device 12', held at the side (and not from underneath) by the cells 14'. The lateral arrangement of the conveyor belt 13' has the advantage that the conveyor belt 13' can, throughout its entire loop—i.e. also in the area of return—run in the same horizontal plane and the cells 14' fixed to it and the packaging units 1' held by them are hence never "upside down". This has the advantage that the whole length of the conveyor belt 13' can be used for processing the packaging units 1'. A further advantage of the second embodiment of the device 12' and in particular the lateral arrangement of the cells 14' lies in the fact that the packaging units 1' are freely positioned and accessible both in the area of their base surfaces 7 and in the area of their gable surfaces 8 and hence the simultaneous processing of both ends of the packaging units 1' is possible. A disadvantage of this embodiment, however, lies in the fact that the lateral arrangement of the conveyor belt 13' makes the simultaneous processing of several rows of cells 14' more complex, from a design point of view.

Figure 3B:
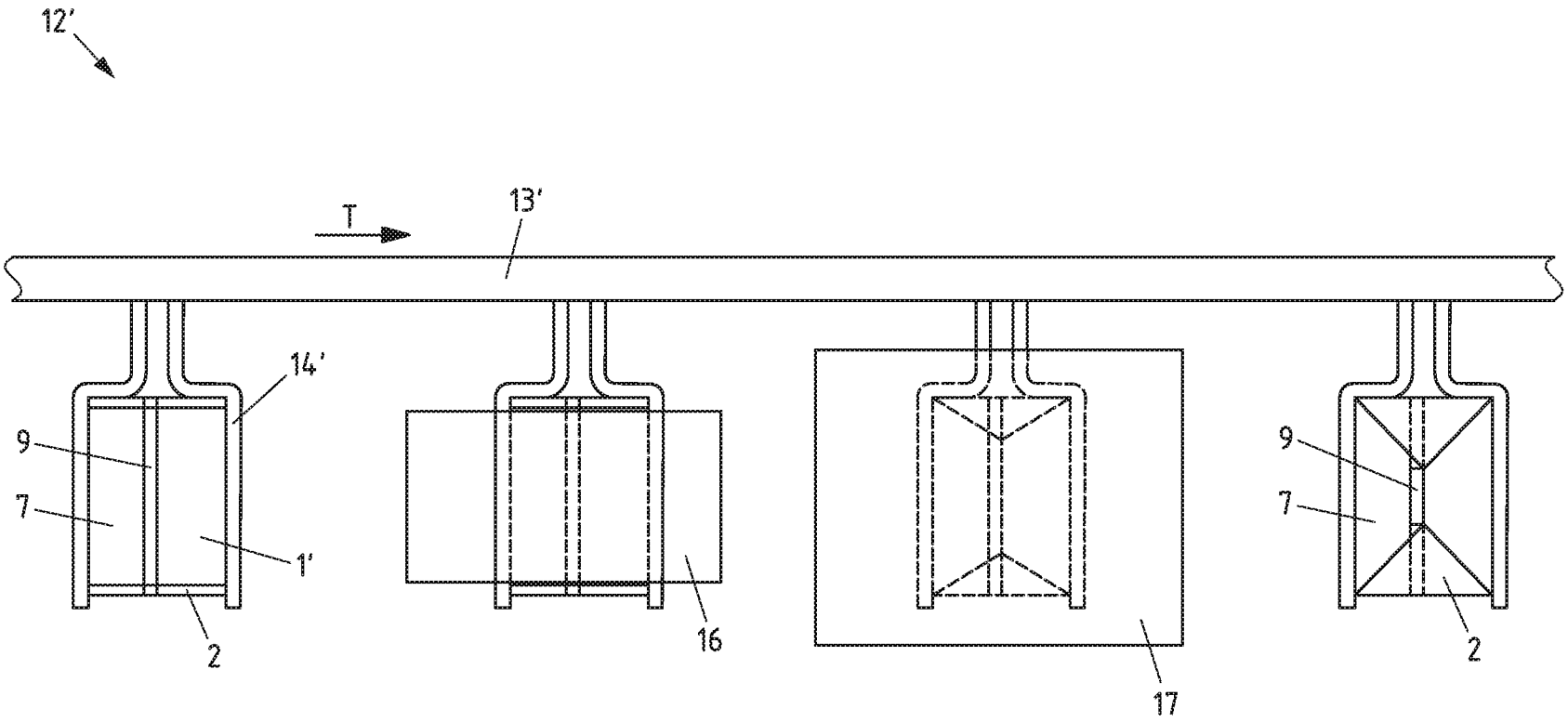
FIG. 3B: the device from FIG. 3A, plan view.

FIG. 3B shows the device 12' from FIG. 3A in a plan view. The areas of the device 12' that have already been described in connection with FIG. 2A to FIG. 3A are given the corresponding reference symbols in FIG. 3B. In the plan view it is clearly discernible that the conveyor belt 13' runs laterally next to the packaging units 1'. Accordingly, the cells 14' also grasp the packaging units from the side.

Figure 3C:
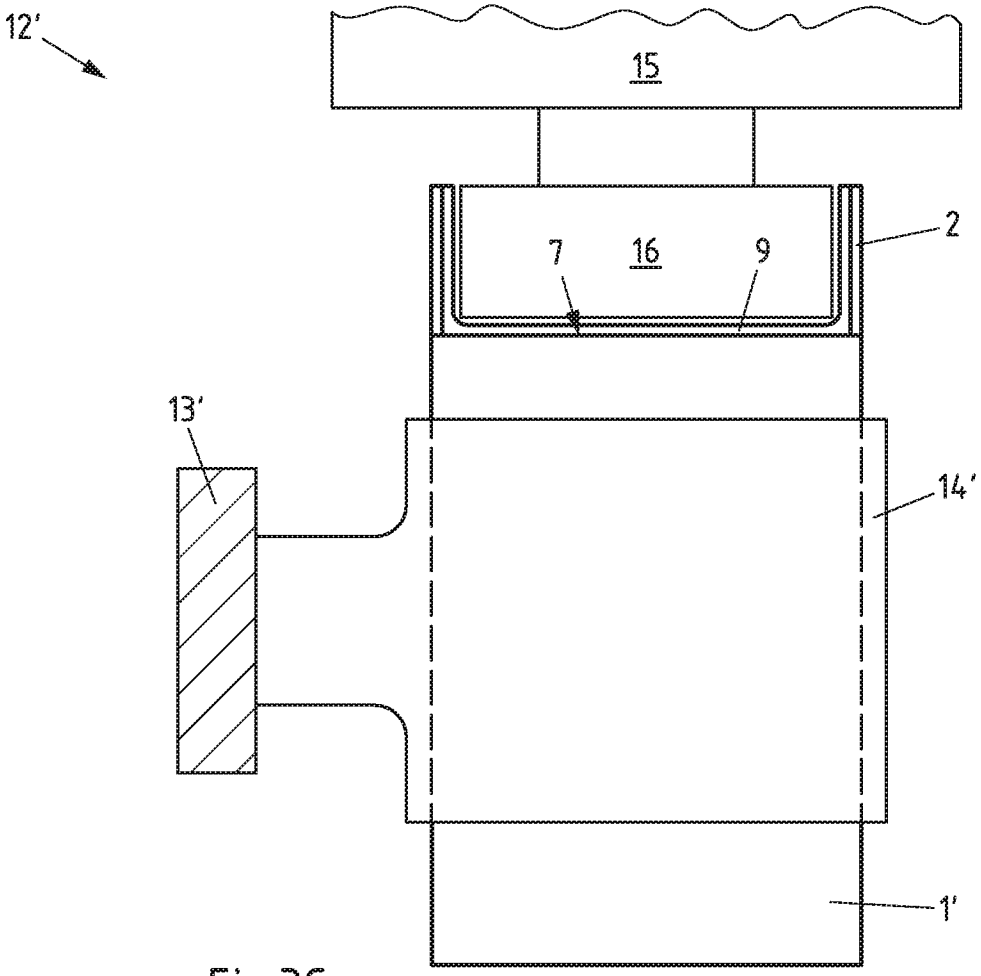
FIG. 3C: the device from FIG. 3A, side view.

FIG. 3C shows the device 12' from FIG. 3A in a side view. The areas of the device 12' that have already been described in connection with FIG. 2A to FIG. 3B have been given corresponding reference symbols in FIG. 3C. In the side view it is clearly discernible that the packaging units 1' are led past the contact elements 16 in such a way that the packaging units 1' are contacted both in the area of their base surfaces 7 and on the inner sides of the protruding ears 2 and are hence dried. The packaging units 1' shown in FIG. 3A to FIG. 3C may for example be the packaging 1' described in connection with FIG. 1B.

Figure 4A:
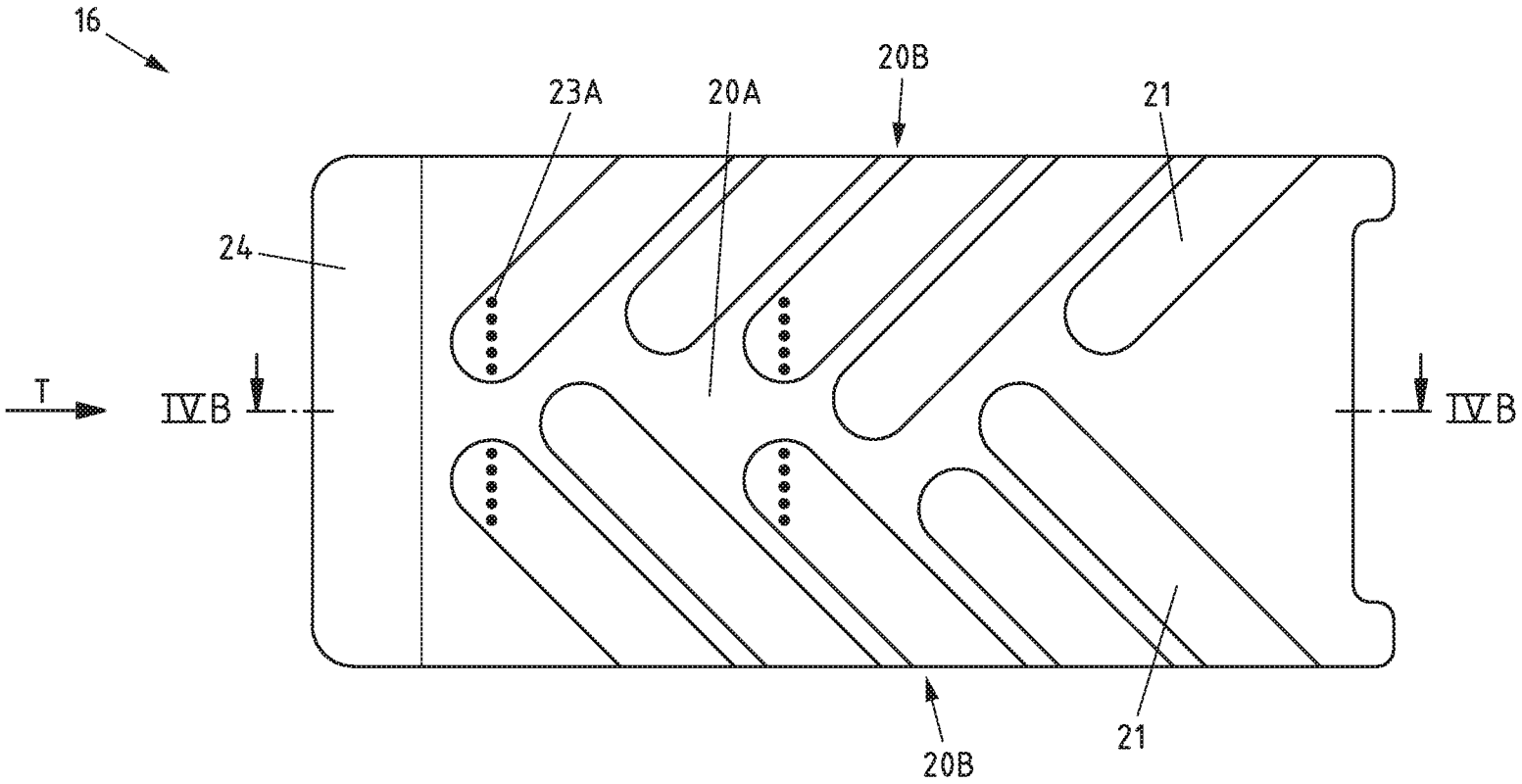
FIG. 4A: the contact element of the drying facility, view from below.

FIG. 4A shows the contact element 16 of the drying facility 15 in a view from below. The contact element 16 has several contact surfaces 20, for example one lower contact surface 20A and two lateral contact surfaces 20B. The contact surfaces 20 are preferably manufactured from plastic, in particular from PEEK (polyether ether ketone) and serve the purpose of wiping of moisture from the surface of the packaging units 1, 1'. With the contact element 16 shown in FIG. 4A and in this respect the preferred contact element, the lower contact surface 20A has a profile with recesses 21. Preferably the recesses 21 run from the middle of the contact surface 20A, viewed in the direction of transport T, diagonally relative to the sides and outwards, in order to be able to drain of moisture well. The contact element 16 has several (not shown in FIG. 4A) channels 22 for carrying a gaseous medium. The outlets 23A of the channels 22 are arranged in the area of the recesses 21. Furthermore, the contact element 16 has a curved inlet area 24.

Figure 4B:
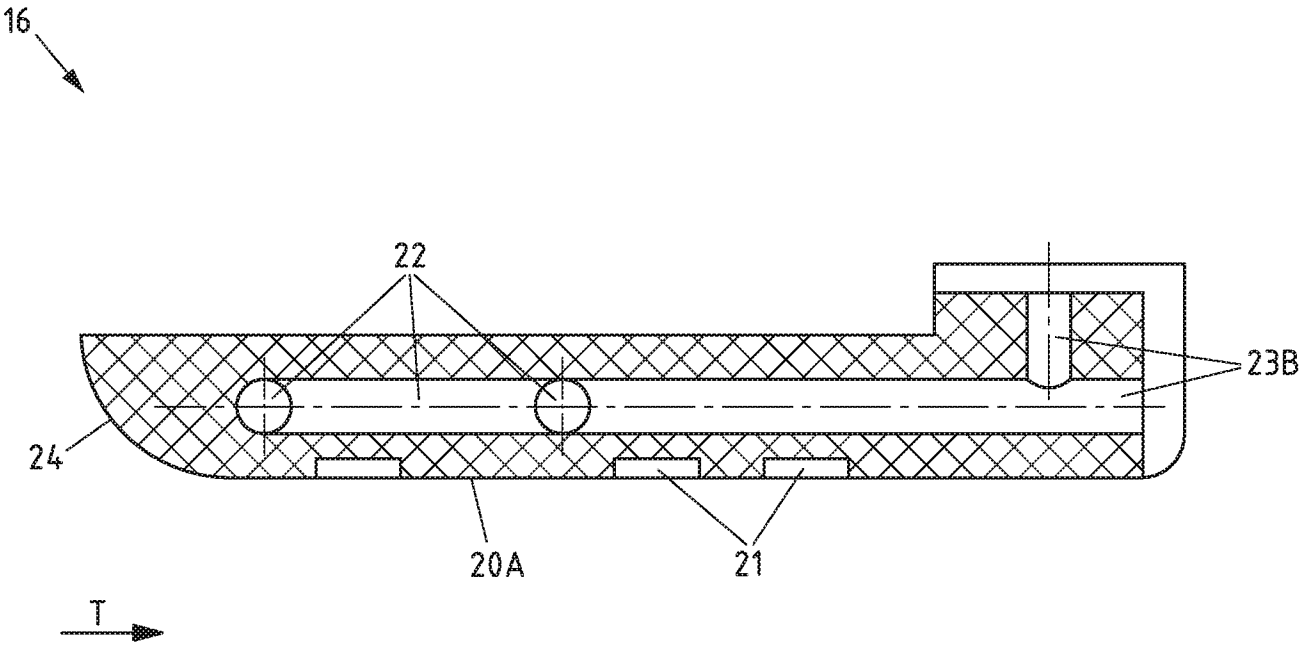
FIG. 4B: the contact element from FIG. 4A in a side view along the section plane IVB-IVB from FIG. 4A.

Finally, FIG. 4B shows the contact element 16 from FIG. 4A in a side view along the section plane IVB-IVB from FIG. 4A. The areas of the contact element 16 already described in connection with FIG. 4A are given corresponding reference symbols in FIG. 4B. In the cutaway view, the course of the channels 22 in the interior of the contact element 16 is clearly recognisable. Through the channels 22 it is possible for example for moisture to be withdrawn by suction from the packaging units 1, 1' by means of the outlets 23A arranged in the lower contact surface 20A and discharged through the outlet 23B. By way of an alternative to this, dry air can be drawn by suction through the outlet 23B and the channels 22 and flow through the outlets 23A arranged in the lower contact surface 20A onto the packaging units 1, 1' that are to be dried.

LIST OF REFERENCE SYMBOLS

1" packaging sleeve
1, 1' packaging (unit)
2, 2' ear
3 first lateral surface
4 second lateral surface
5 front surface
6 rear surface
7 base surface
8 gable surface
9, 9' fin seal
10 pouring element
11 screw cap
12, 12' device
13, 13' conveyor belt
14, 14' cells
15 drying facility
16 contact element
17 facility for attaching ears
18 drive
19 cross member
20, 20A, 20B contact surface (of the contact element 16)
21 recess
22 channel
23A, 23B outlet (of channel 22)
24 inlet area
T: transport direction (of packaging 1, 1')
Θ: contact angle

The invention claimed is:

1. A device for the drying of packaging, comprising:
a conveyor belt with cells for receiving the packaging, and
at least one drying facility for the drying of the packaging,
wherein the drying facility has at least one contact element with at least one contact surface,
wherein the contact surface of the contact element is made from plastic, and
wherein the contact surface of the contact element has a profile with at least one recess.

2. The device according to claim 1, further comprising a facility for attaching protruding ears to the packaging.

3. The device according to claim 1, wherein the drying facility has at least two contact elements.

4. The device according to claim 1, wherein the contact element has at least one channel for carrying a gaseous or liquid medium.

5. The device according to claim 4,
wherein the at least one contact surface comprises a lateral contact surface and/or a lower contact surface, and wherein
at least one outlet of the at least one channel is arranged on the lateral contact surface and/or on the lower contact surface of the contact element.

6. The device according to claim 1, wherein the contact element has a curved inlet area or an inlet area inclined relative to the contact surface.

7. A method for drying packaging filled with foodstuffs comprising:

using the device according to claim 1.

8. A method for the drying of packaging, comprising:

a) providing the device for the drying of packaging according to claim 1, b) providing packaging, and c) drying the packaging, wherein the packaging is, in Step c), dried by means of a contact between the packaging and the contact element of the drying facility, wherein in Step c) the packaging is moved whilst the drying facility stays still.

9. The method according to claim 8, wherein in Step a) the device comprises a conveyor belt with cells for receiving the packaging.

10. The method according to claim 8, wherein the at least one contact surface comprises lateral contact surfaces and/or a lower contact surface, and wherein the packaging is, in Step c), dried by means of a contact between the packaging and the lower contact surface and/or the lateral contact surfaces of the contact element of the drying facility.

11. The method according to claim 8, further comprising:

d) attaching of protruding ears to the packaging.

12. The device according to claim 1, wherein the plastic comprises an elastomer or a thermoplastic.

13. The method according to claim 8, wherein the plastic comprises an elastomer or a thermoplastic.

14. The method according to claim 8, wherein the packaging is formed from packaging sleeves.

* * * * *